US010245453B2

(12) United States Patent
Gray

(10) Patent No.: US 10,245,453 B2
(45) Date of Patent: Apr. 2, 2019

(54) SAFETY AIRBAG SYSTEM

(71) Applicant: Zero Shock, LLC, Azusa, CA (US)

(72) Inventor: Stephen Gray, Azusa, CA (US)

( * ) Notice: Subject to any disclaimer, the term of this patent is extended or adjusted under 35 U.S.C. 154(b) by 0 days.

(21) Appl. No.: 14/511,766

(22) Filed: Oct. 10, 2014

(65) Prior Publication Data

US 2016/0101300 A1 Apr. 14, 2016

(51) Int. Cl.
*A62B 1/22* (2006.01)
*A63B 6/02* (2006.01)
*A63B 6/00* (2006.01)

(52) U.S. Cl.
CPC ..... *A62B 1/22* (2013.01); *A63B 6/00* (2013.01); *A63B 6/02* (2013.01)

(58) Field of Classification Search
CPC .... A62B 1/20; A62B 1/22; A63B 6/00; A63B 6/02
See application file for complete search history.

(56) References Cited

U.S. PATENT DOCUMENTS 1,166,811 A * 1/1916 Bowers ..... A62B 1/22 114/219
1,985,432 A * 12/1934 Tucker ..... A47C 27/081 182/137
2,906,366 A * 9/1959 Mapes ..... A62B 1/22 182/139
2,975,855 A * 3/1961 Dudek ..... A62B 1/22 182/137
3,369,808 A * 2/1968 Sconce ..... A63B 6/02 182/137
3,513,491 A * 5/1970 Gordon ..... A47C 27/00 182/137
3,851,730 A * 12/1974 Scurlock ..... A62B 1/22 182/137
3,892,401 A * 7/1975 Sorenson ..... A63B 6/02 482/15
4,068,739 A * 1/1978 Gordon ..... A62B 1/22 182/139
4,215,857 A * 8/1980 Gordon ..... A63B 6/02 482/15
4,279,044 A * 7/1981 Douglas ..... A43B 3/0084 5/654
4,431,182 A * 2/1984 Reynolds ..... A63G 31/08 124/26
4,875,548 A * 10/1989 Lorsbach ..... A62B 1/22 182/137
7,357,728 B2 4/2008 Osler-Weppenaar

FOREIGN PATENT DOCUMENTS

DE 2915303 A1 * 11/1979 ..... A62B 1/22
WO WO 2010112953 A1 * 10/2010 ..... A62B 1/22

* cited by examiner

*Primary Examiner* — Colleen M Chavchavadze

(57) ABSTRACT

A safety airbag device for cushioning the free fall of a person or object from an elevated height. The airbag device includes an inflatable base bag capable of sustaining an air pressure and an inflatable structure coupled to the base bag, where the inflatable structure is in air communication with the base bag. A net is coupled to a top portion of the inflatable structure for decelerating and supporting the individual from free fall. A top cover is coupled to the base bag that substantially encloses the inflatable structure.

27 Claims, 5 Drawing Sheets

SAFETY AIRBAG SYSTEM

BACKGROUND

1. Technical Field

The present disclosure generally relates to a safety cushioning device and, more particularly, to an airbag device incorporating one or more inflatable tubes for absorbing the impact of a person or object at the end of a fall or jump from an elevated height.

2. Related Art

Safety devices for absorbing the impact of people free falling or jumping from elevated heights are regularly employed in extreme sports, amusement, and circus environments. For example, in circus environments a person may be shot from a cannon into a high arc, ending with a free fall into a net. Similarly, acrobats swinging high overhead on a trapeze may end a performance with a somersault or free fall into a net below.

In other examples, a movie stuntman may jump or fall from the top of a structure or high building onto a large airbag below. In extreme sports, very difficult and dangerous maneuvers and acrobatics, particularly aerial maneuvers and acrobatics, are attempted and the performer, upon returning to earth, may be cushioned by an airbag.

One of the problems with large air-filled bags sometimes used by stuntmen or extreme sports performers is that it takes a considerable amount of time for these bags to re-inflate or re-coil after a use. In applications, such as amusement or fun park environments, where aerobatic stunts are performed continuously in short intervals, the time it takes to re-coil the airbag is critical.

Also, the over-pressurization of certain existing airbags presents a possible safety hazard. In particular, the pressurization of certain airbags creates a bounce-back or re-bound factor that makes it potentially dangerous for anyone falling outside of a central area, or "sweet spot," of the airbag. In the same way, the use of safety nets are mostly limited to trained professionals because of the potential to ensnare or otherwise injure limbs if one falls into the net the wrong way.

An additional potential safety hazard present in existing safety airbags is the use a single top sheet for the landing surface. In the event that the top sheet is ripped or otherwise damaged during use, the airbag could possibly rupture, or the person using the device could possibly be injured by falling through the top sheet in the airbag interior.

Inflatable airbag safety devices currently exist that incorporate one or more collapsible pop-up tubes (sometimes called "crumple tubes") to cushion the free fall of an individual. For example, U.S. Pat. No. 7,357,728 discloses one such device. Such devices sometimes use a top sheet to serve as the landing surface. The top sheet is, in turn, fastened on its underside to the top of each collapsible tube. In the event that the top sheet is damaged or otherwise compromised during use, the top sheet can only be disassembled and exchanged by deflating the entire airbag and detaching each collapsible crumple tube from the underside of the top sheet, which is a very inefficient and time-consuming process.

Accordingly, a need therefore exists for a durable, safe and air-efficient device for absorbing the impact of persons or objects free-falling from elevated heights for amusement, recreation, entertainment, commercial, safety and fire/rescue purposes. A need also exists for an airbag safety device having a landing surface that may be quickly assembled and disassembled for repair and/or re-use.

SUMMARY

An airbag device is provided for cushioning the free fall of an individual from an elevated height. In one example, the device may include an inflatable base bag capable of sustaining an air pressure, and an inflatable structure coupled to the base bag, where the inflatable structure is in fluid communication with the base bag. A net may be coupled to a top portion of the inflatable structure, where the net is adapted to catch and decelerate the individual from free fall.

A safety system for cushioning the free fall of an individual from an elevated height is also provided. The system includes an inflatable base bag capable of sustaining an air pressure, and an inflatable structure coupled to the base bag, where the inflatable structure is on in fluid communication with the base bag. A net may be coupled to a top portion of the inflatable structure, where the net is adapted to catch and decelerate the individual from free fall. A top cover may be coupled to the base bag by at least one fastener. The top cover may include a top sheet and side sheets that substantially enclose the inflatable structure.

An additional implementation of an airbag device for cushioning the free fall of an individual from a height is further provided. In this example, the device may include an inflatable base bag capable of sustaining an air pressure, and an inflatable structure coupled to the base bag, where the inflatable structure is in fluid communication with the base bag. A top cover may be coupled to the base bag, where the top cover includes a top sheet and side sheets that substantially enclose the inflatable structure.

In most implementations, the inflatable structure includes a plurality of crumple tubes coupled to the base bag, where each crumple tube is in fluid communication with the base bag. In most instances, the crumple tubes are inflated to about the same height. However, in other implementations at least one of the crumple tubes may be taller than the others, where the taller crumple tubes are positioned on the airbag device to form a target for individuals to attempt to clear when landing on the airbag.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE FIGURES

The present disclosure may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

Figure 1:
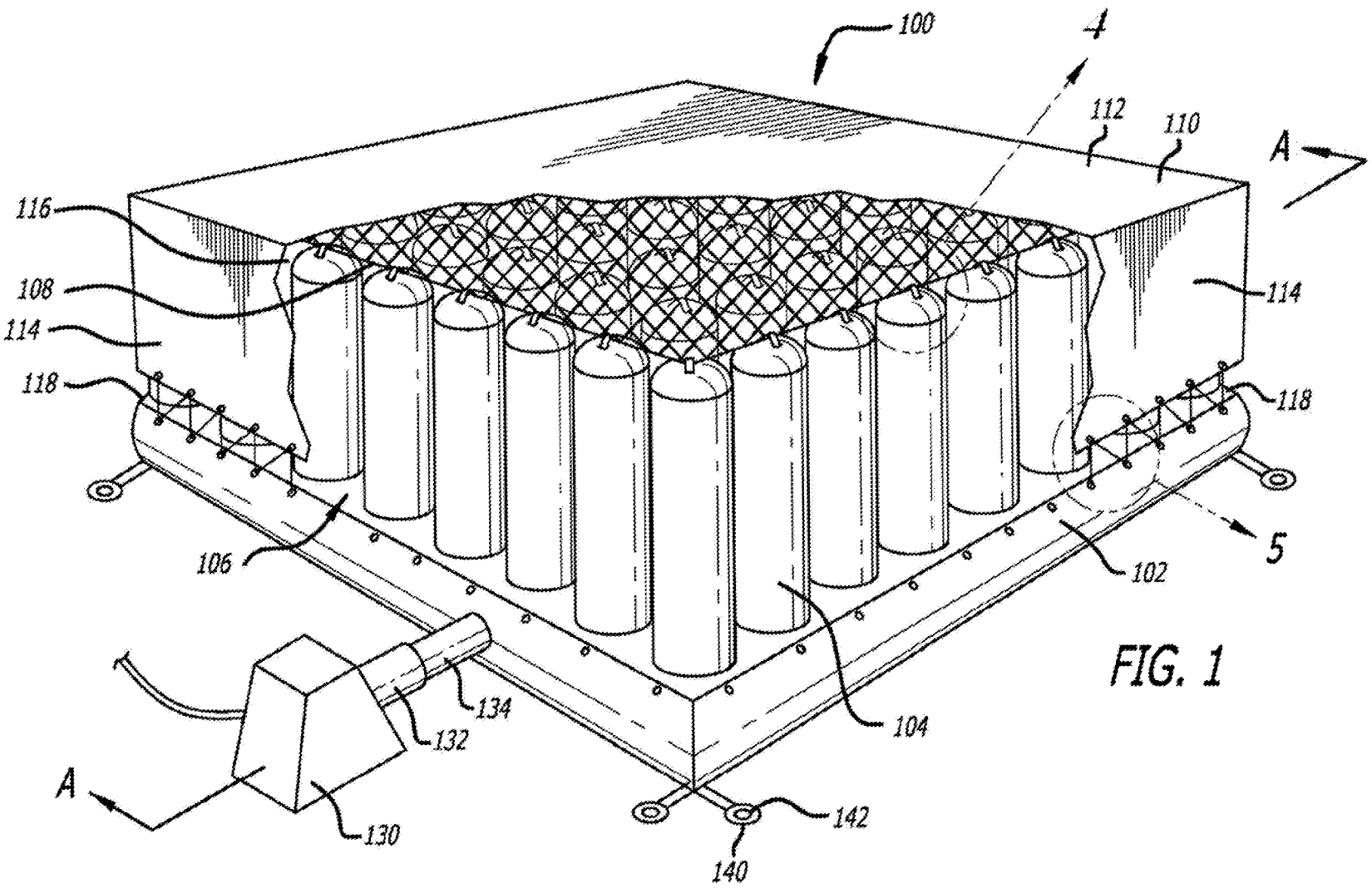
FIG. 1 is a perspective view of one example of an implementation of a safety airbag system of the present disclosure.

FIGS. 1-9 illustrate examples of different implementations of a safety airbag system 100 for cushioning the free fall of an individual from an elevated height. The system 100 includes an inflatable base bag 102 which rests on the earth, floor or other support surface, a plurality of crumple tubes 104 coupled to a top wall of the base bag 102 that, collectively, form an inflatable structure 106. The system 100 further includes netting 108 attached to a top portion of the crumple tubes 104, and a top cover 110 that overlays the inflatable structure 106. The top cover 110 provides an air-cushioned landing surface for an individual free-falling from an elevated height. The base bag 102, crumple tubes 104, and top cover 110 may be constructed of any relatively flexible airtight or semi-permeable material, such as canvas, nylon, plastic, polyvinyl chloride (PVC), thermoplastic rubber (TPR), ethylene vinyl acetate (EVA), thermoplastic polyurethane elastomer (TPU), neoprene-coated fabric or other suitable materials. The disclosed airbag system 100 may be useful as a safety device in any field, including entertainment, recreation, amusement, fall-arrest safety and fire rescue, in which individuals may be working, performing, playing, sliding, or otherwise standing on and have the potential to fall from elevated structures.

Figure 2:
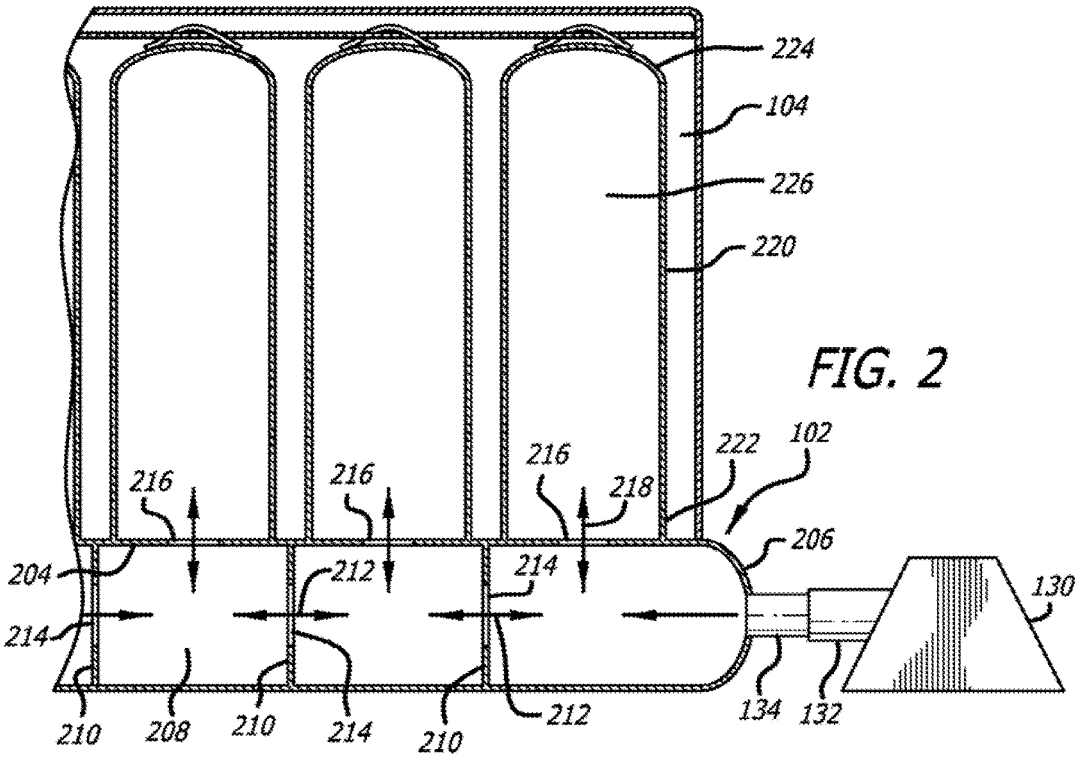
FIG. 2 is a partial cross-sectional view of the safety air bag system illustrated in FIG. 1, taken across line A-A.

As shown in FIGS. 1 and 2, the base bag 102 is an inflatable bladder having a bottom wall 202, a top wall 204, and a peripheral sidewall 206. The bottom wall 202, top wall 204, and sidewall 206 form an inflatable air chamber 208. The sidewall 206 is attached, for example by sewing, stitching, welding, radio-frequency (RF) welding, hot-air welding, gluing or other means known in the art, between the top wall 204 and the bottom wall 202 in such a way that permits a limited but continuous amount of air to leak from the air chamber 208 when the base bag 102 and crumple tubes 104 are fully inflated. This prevents "ballooning" or over-inflation of the inflatable structure 106.

Turning now to FIG. 2, the air chamber 208 may be separated into sections by one or more baffles 210, which act as tensioning structures that shape and maintain the integrity of the base bag 102 when the air chamber 208 is pressurized, so that the top wall 204 of the bag lies, for example, relatively flat. Air communication between the sections, denoted by arrows 212, is permitted by one or more vents 214 formed in each baffle 210. The base bag 102 further includes one or more breather holes 216 formed in the top wall 204 to permit airflow, denoted as arrows 218, to and from the crumple tubes 104.

The breather holes 216 further connect the base bag 102 with the crumple tubes 104 such that air pressure within the base bag 102 maintains the crumple tubes 104 in an extended (i.e., inflated) position. The breather holes 216 may be constructed to any size or shape, depending on the desired application, to provide a soft landing for a person landing on the inflatable structure 106 via the crumple tubes 104. For example, in some applications the breather holes may have a diameter in the range of about 20 to 50 millimeters.

The base bag 102 may be constructed to any length, width, and height suitable for the desired application to provide a soft landing for the person landing on the device. For example, in some applications the base bag 102 may be about 10 meters in length, 5 meters in width and 2 meters in inflated height. In other applications, the base bag may be 20 meter in length and 20 meter in width. In most applications, a typical operating pressure within the inflatable structure may be greater than about 0.5 pounds per square inch gauge and, preferably, in the range of about 2 to 3 pounds per square inch gauge. However, the operating pressure may be adjusted to any pressure range depending on the application and the desired firmness and stability to cushion falls from varying heights.

Each crumple tube 104 is an inflatable airbag that includes an elongated annular tube wall 220 having an open end 222 and a closed top end 224. The tube wall 220 defines an interior cavity 226 for receiving air. The crumple tubes 104 are coupled to the base bag 102 at the open end 222, over the breather holes 216 formed in the top wall 204 of the base bag 102. The crumple tubes 104 may be coupled to the base bag 102 using any suitable coupling technique, such as sewing, high-frequency coupling, hot coupling (e.g., heat sealing, melting, welding), or adhering (e.g., gluing), for example.

In some implementations, the crumple tubes 104 may be arranged in a series of parallel columns and rows to form the rectangular configuration shown in FIG. 1. In such implementations, the crumple tube may be spaced between about 7 centimeters (3 inches) and 21 centimeters (8 inches) apart, where the parallel rows of crumple tubes 104 form elongated walls extending across the width of the airbag device.

In other implementations, the crumple tubes 104 may be arranged in parallel columns and rows to form a circular, square, triangular, pentagonal, or other geometric configuration. In such implementations, the geometric shape of the base bag 102 may be adapted to correspond to the geometric configuration of the crumple tubes 104.

The crumple tubes 104, as illustrated in FIG. 2, may comprise a circular cross section. However, in other implementations, the crumple tube 104 cross section may comprise other geometric shapes, for example an oval, triangular, square or rectangular shaped cross section. While the air pressure tends to form the tops of the crumple tubes 104 into a semi-circular shape, various shapes may be attained by means well known in the art, such as by welding seams to the material of the crumple tubes in a desired shape, or including internal baffles.

Figure 7:
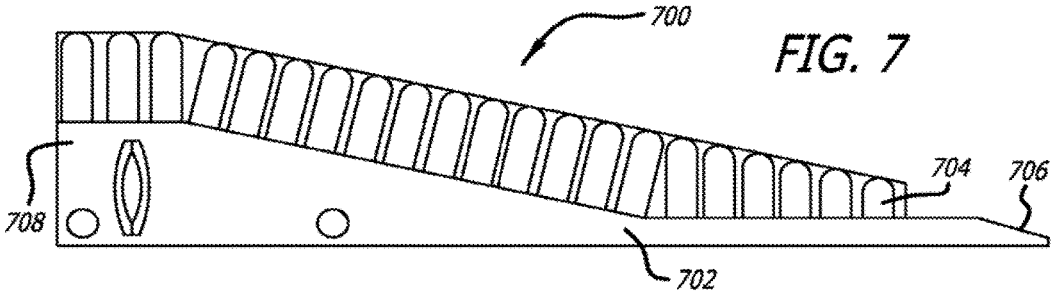
FIG. 7 is a side plan view of a second example of an implementation of an airbag system of the present disclosure.

In most applications, all of the crumple tubes 104 may be inflated to the same height. However, in some applications, at least one of the crumple tubes 104 may be taller than the others, as shown in FIG. 7. In other applications, the taller crumple tubes 104 may be positioned on the airbag device to form a target for individuals to attempt to clear when landing on the airbag.

The crumple tubes 104 may be constructed to any diameter and height appropriate, depending on the application, to provide a soft landing for a person landing on the device. In some implementations, the crumple tubes 104 may be between 8 inches and 18 inches, and most preferably 12 inches in diameter, and about 2 meters in inflated height.

Figure 3:
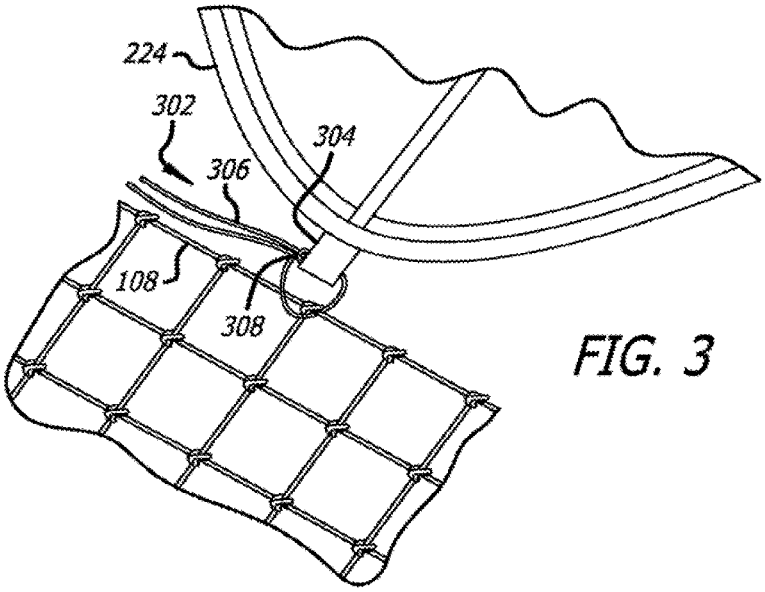
FIG. 3 is an enlarged perspective view illustrating how the netting may be attached to a top portion of the crumple tubes of the safety airbag system of FIG. 1.

FIG. 3 is an enlarged perspective view of the top end 224 of the crumple tubes 104. As shown, a fastener 302 may be used to secure the netting 108 to the top of each crumple tube 104. The fastener 302 may include a rope, hook-and-loop fastener, a Velcro® strap, a Panduit strap, or other durable fastening means.

For example, the fastener 302 shown in FIG. 3 is rope-and-loop fastener. In this example, a loop 304 of material, formed, for example, from a strip of canvas, seatbelt webbing, or other durable material, may be sewn or otherwise coupled to the top end 224 of each crumple tube 104.

A rope 306 may be passed through the loop 304 and netting 108 to secure the netting 108 to the top of the crumple tubes 104. In some implementations, the rope 306 may be a ⅛ inch nylon rope or any other rope of suitable construction. Once the rope 306 is passed through the loop 304 and through-and-over the netting 108, the rope 306 may be fastened in a loop by a knot 308, for example, a figure-eight knot, double or triple knot.

Figure 4:
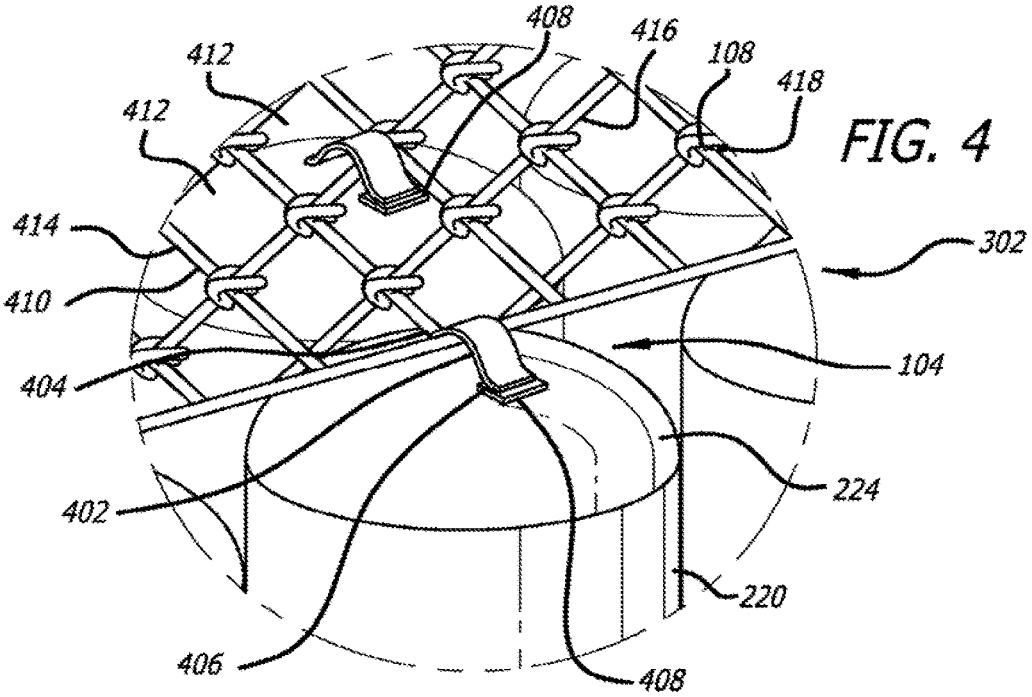
FIG. 4 is an enlarged perspective view illustrating a second example of how the netting may be attached to the top portion of the crumple tubes of the safety airbag system of FIG. 1.

FIG. 4 is an enlarged perspective view of the top end 224 of the crumple tubes 104. This figure illustrates another implementation of the fastener 302. In this example, the fastener 302 may include a Velcro® strap 402. In one example implementation, one end 404 of the strap may be sewn or otherwise affixed to one portion of the top end 224, while the opposite end 406 of the strap may include a strip of Velcro® that mates, in hook and loop engagement, with a corresponding strip of Velcro® 408 affixed to a second portion of the top end 224. In this way, the straps may loop through-and-over the netting 108 mesh. In another example implementation, both ends 404 and 406 may mate with corresponding strips of Velcro® affixed to the top end 224 of the crumple tubes 104.

In the exemplary implementations show in FIGS. 1-4, the netting 108 is secured to the top ends 224 of each crumple tube 104. The netting 108, being fastened to the top ends 224 of the crumple tubes 104, joins the crumple tubes so that when a person lands atop the crumple tubes 104, the surrounding crumple tubes lean towards the impact zone and contribute to a soft landing.

In other implementations, not all of the crumple tubes 104 carry fasteners and/or the netting 108 may be secured to only a select group of crumple tubes 104, for example, the crumple tubes 104 on the perimeter of the netting 108. The netting 108 only needs to be attached to a sufficient number of crumple tubes 104 to hold the netting 108 and prevent a person landing on the airbag system 100 from falling through the netting 108 and between the crumple tubes 104.

As shown in detail in FIG. 4, the netting 108 may be formed from a plurality of ligaments or frame members 410 that define a plurality of open cells 412 therebetween. When a user lands atop of the crumple tubes 104, thereby engaging the netting 108, the frame members 410 may be placed in tension to help support the user and prevent them from falling through the inflatable structure 106 (i.e., in between the crumple tubes 104). Adjacent frame members 410 may be spaced apart at regular intervals to provide the netting 108 with a substantially constant tensile strength.

The frame members 410 may be arranged in a grid pattern, including a first set of spaced-apart and parallel frame members 414 and a second set of spaced-apart and parallel frame members 416. In this grid pattern, the first set of frame members 414 is transverse to the second set of frame members 416 such that the first set of frame members 414 intersects the second set of frame members 416 at a knot 418. In this example, the netting 108 may be constructed by knotting together twine, wire, rope, or threads, where each of the first and second set of frame members 414 and 416 may comprise a single, double, or triple strands of nylon, polyester or other durable material. In example shown in FIG. 4, the first set of frame members 414 intersects the second set of frame members to form a lattice of, evenly spaced, diamond-shaped open cells 412.

In some implementations, for example when used with airbag systems 100 having smaller dimensions, the netting 108 may comprise a mesh of durable material. For example, the netting 108 may comprise a knotted or knot-less, raschel mesh made of nylon, polyester or other suitable material.

Turning back to FIG. 1, the top cover 110 includes a top sheet 112 and side sheets 114 that, together, form an open-ended enclosure 116. The top cover 110 is constructed to overlay the inflatable structure 106, such that the crumple tubes 104 and the netting 108 are enclosed within the enclosure 116. The top sheet 112 is configured to provide a landing surface for a person landing on the device.

Figure 5:
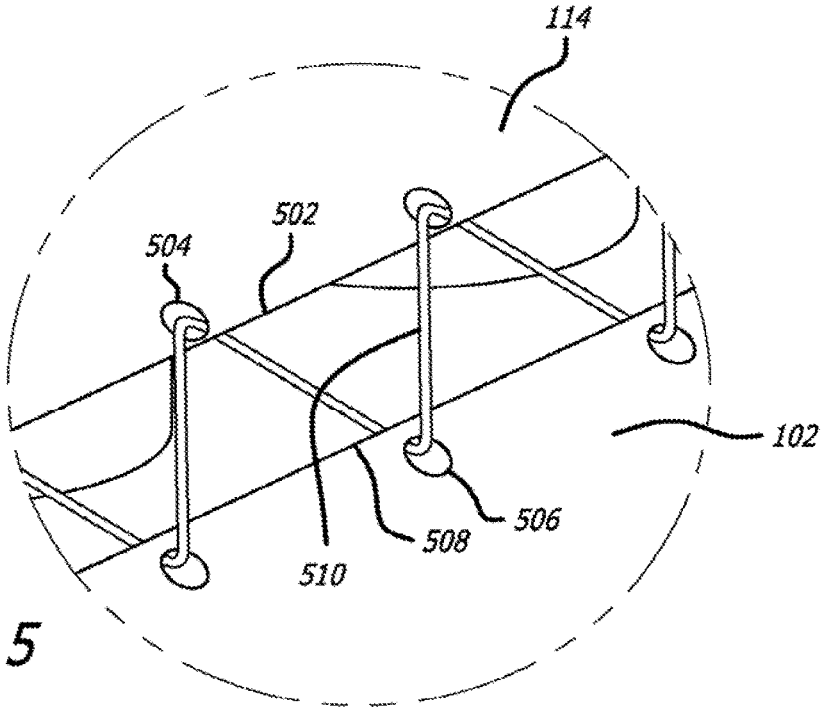
FIG. 5 is an enlarged perspective view illustrating how the top cover is coupled to the base bag of the safety airbag system of FIG. 1.

FIG. 5 is an enlarged perspective view of a bottom edge 502 of a top cover side sheet 114. As shown, a first series of grommet holes 504 may be formed along the bottom edge 502 of each side sheet 114. When the top sheet 112 is installed over the inflatable structure 106 (i.e., the crumple tubes 104 and netting 108), the first series of grommet holes 504 may align with a corresponding second series of grommet holes 506 formed along a top edge 508 of the base bag 102. A retaining strap or wire 510, for example an elastic bungee, shock cord, or rope, may be passed through each of the corresponding first and second grommet holes 504 and 506 to securely fasten the top cover 110 to the base bag 102.

Returning to FIG. 1, the base bag 102 and crumple tubes 104 may be inflated by one an air blower 130. The air blower 130 may include an outlet 132 for passing air to the inflatable structure 106 through an inlet tube 134 coupled to the base bag 102. The size (i.e., horsepower or rpm) of the air blower 130 may vary depending on the application. For example, a 1 hp air blower may be used to inflate the inflatable structure 106 and blow constant air into the base bag 102 and crumple tubes 104. In other examples, a ½ hp blower may be used, for example, for a very small bag, or 2 hp blower may be used, for example, for a large bag employed to cushion the end of an extreme snowboarder's jump, trick or stunt. Airbags having substantially large dimensions may employ two or more air blowers to inflate the base bag 102 and crumple tubes 104.

The base bag 102 may further include one or more anchor straps 140 coupled to each corner of the base bag 102. Each anchor strap 140 may include a buckle 142 for receiving a stake to anchor the base bag 102, for example, into the ground. In other implementations, the anchor straps 140 may include hook ends or other means for securing the base bag 102 to an adjoining structure or apparatus.

During assembly and installation of the airbag system 100, the netting 108 may first be fastened to the top ends of crumple tubes 104 while the base bag 102 and crumple tubes 104 are deflated. After the netting 108 is fastened to the crumple tubes 104, the top cover 110 may be fastened to base bag 102 by the restraining strap 510. Once the netting 108 and the top cover 110 are installed, the base bag 102 and inflatable structure 106 may be inflated to its operable configuration, as shown in FIG. 1.

In use, the user and/or the user's equipment, e.g. skis, snowboard, bicycle, skate, skateboard, or the like, impacts the top cover 110 of the airbag system 100, which "gives" in response to impact and transmits the impact load to the crumple tubes 104, which further absorbs impact and spreads the impact load to the base bag 102. The base bag 102 substantially cushions and absorbs the impact. The base bag 102 may further include one or more vents or valves through which air can escape relatively in response to the impact of the user's landing, thereby to substantially cushion the user's landing.

The airbag system 100 may be disassembled by deflating the base bag 102 and inflatable structure 106, detaching the top cover 110 from the base bag 102 and removing the top cover from the inflatable structure 106, and detaching the netting 108 from the top ends of the crumple tubes 104. After the detaching the netting 108, the deflated the base bag 102 and inflatable structure 106 may be folded for storage.

In situations where the top cover 110 is damaged during use, the damaged top cover 110 may be removed and exchanged with a new top cover without deflating the inflatable structure 106. In other situations where it is desired to change the top cover 110, for example for advertising purposes, to change a branding or logo embossed on the top cover 110, the top cover 110 may be exchanged relatively quickly with deflating the base bag 102 and inflatable structure 106.

Figure 6:
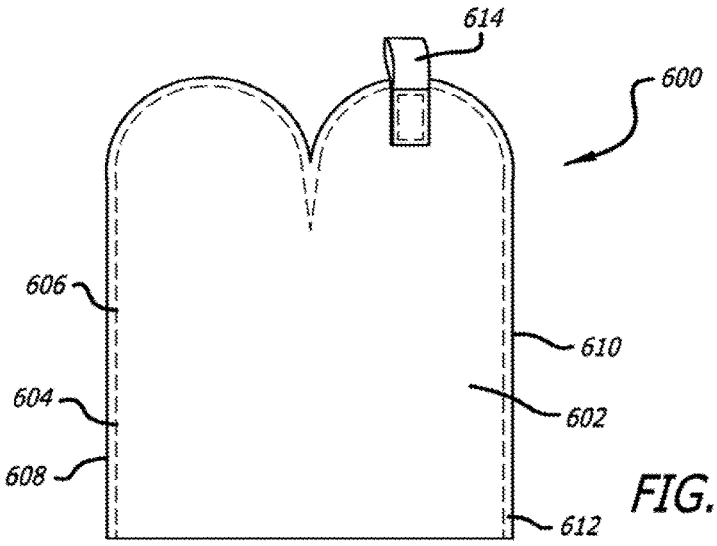
FIG. 6 is a plan view illustrating an exemplary construction of a crumple tube of the present disclosure.

FIG. 6 is a plan view illustrating an exemplary construction of a crumple tube 600 of the present disclosure. As shown, in implementations using tubular shaped crumple tubes, each crumple tube 600 may be constructed from a double arch-shaped pattern of material 602 having a stitch seam 604 that runs along the sides and top of the pattern 604. The stitch seam 604 includes a first stich line 606 formed along one side 608 of the pattern 602, and a second stich line 610 formed along an opposing side 612 of the pattern 602. The crumple tubes 600 may form a tubular shape by sewing sides 608 and 612 together along the first and second stitch lines 606 and 610. For implementations using a rope-and-loop fastener, a loop 614 may be fastened to the top of one end of the pattern of material 602, prior to sewing the sides 608 and 612 of the pattern of material 602 together. In other implementations, the sides 608 and 612 of the pattern of material 602 may be welded or glued together along the first and second stitch lines 606 and 610.

FIG. 7 is a side plan view of another example of an implementation of an airbag system 700 of the present disclosure. In this example, the system 700 includes a base bag 702 constructed in the form of a multi-tiered ramp. In this example, the system 700 further includes crumple tubes 704 having varying inflated heights. In particular, the height of the crumple tubes 704 progressively increase from a front end 706 of the base bag 702 to a rear end 708 of the base bag 702.

Figure 8:
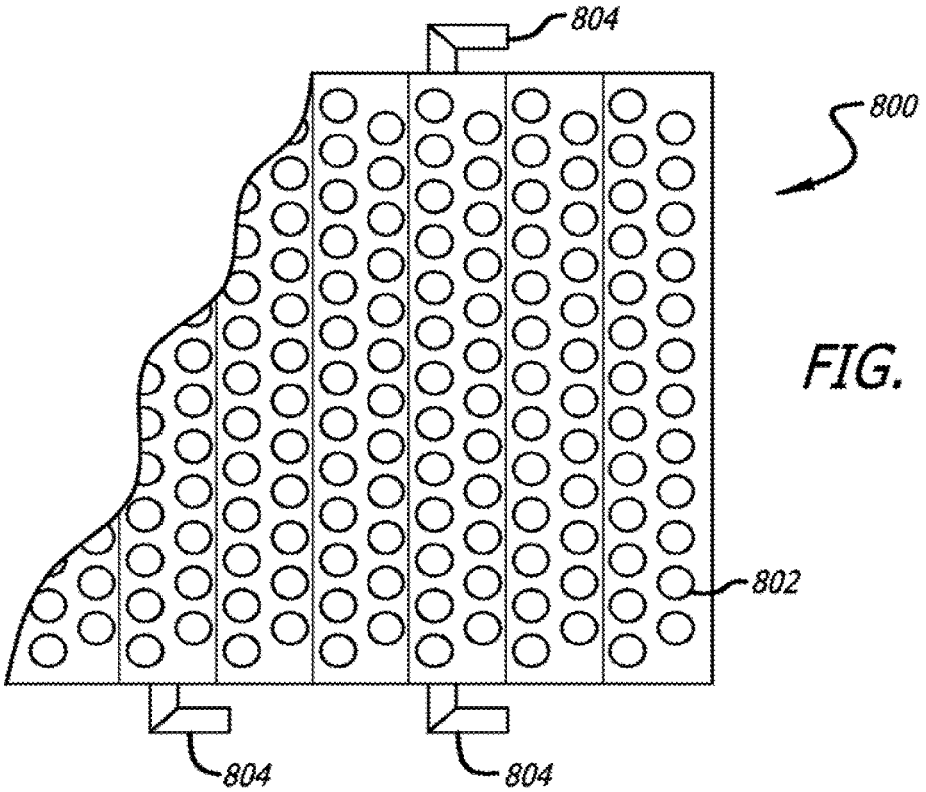
FIG. 8 is a top plan view of a third example of an implementation of an airbag system of the present disclosure.

FIG. 8 is a top plan view of a further example of an implementation of an airbag system 800 of the present disclosure. In this example, the system 800 includes crumple tubes 802 arranged in a staggered configuration. In this example, the airbag system 800 may include a plurality of inlet tubes 804 for inflating the base bag.

Figure 9:
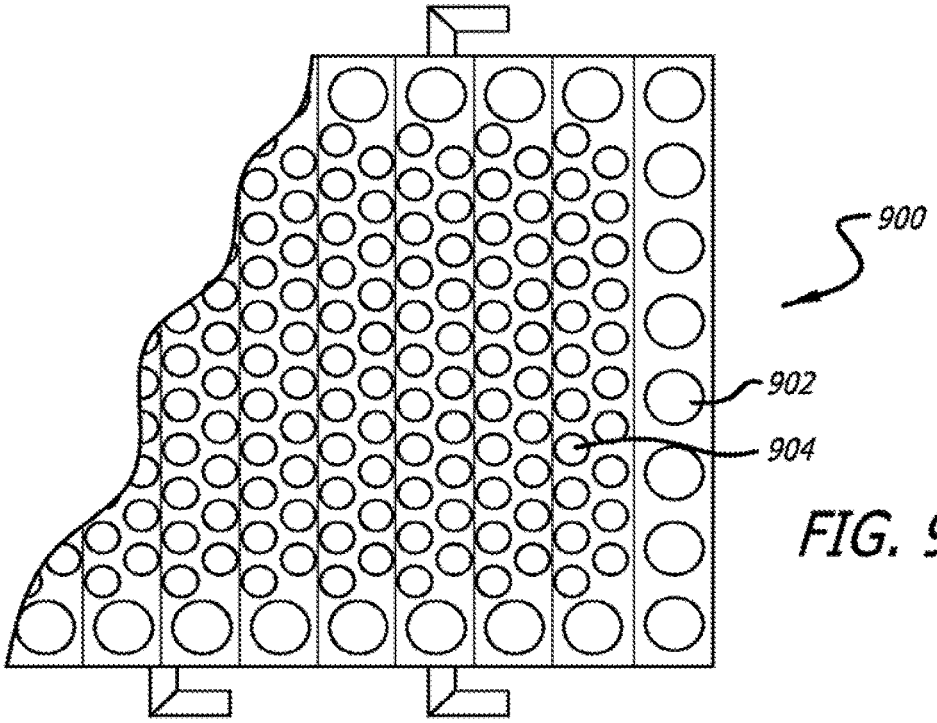
FIG. 9 is a top plan view of a fourth example of an implementation of an airbag system of the present disclosure.

FIG. 9 is a top plan view of yet another example of an implementation of an airbag system 900 of the present disclosure. In this example, the system 900 includes a first group of crumple tubes 902 disposed about a second group of crumple tubes 904. The first group of crumple tubes 902 may have a larger cross-sectional diameter than the second group of crumple tubes 904 to define a target for the user to attempt to "hit" when landing on the airbag.

Airbag safety systems according to the present disclosure provide many advantages over existing airbag safety devices systems. For example, the netting used in airbag safety systems of the present disclosure provides an additional restraint to catch an individual from free fall. If, for instance, the landing surface or cover of the airbag is damaged or otherwise compromised during use, the netting prevents the user from falling through landing surface or cover into the interior of the airbag.

A second advantage of airbag safety systems according to the present disclosure is that they provide a quick and easy means for replacing a damaged or worn-out landing surface or airbag cover. If the landing surface or cover of the airbag is damaged or otherwise compromised during use, then it may be necessary to repair or replace the landing surface rapidly so the device may be used again in a short amount of time. Replacing the landing surface or cover of the airbag can be a tedious consuming process for some existing airbag safety devices. In particular, for those airbags that use a top sheet fastened to the top of a plurality of collapsible pop-up tubes, untying the top sheet from each collapsible tube, removing or repairing the top sheet, and then tying the top sheet back onto each collapsible tube can be an extremely time-consuming process, e.g., some airbags may consist of 200 or more collapsible tubes. Airbag safety systems according to the present disclosure solves this problem because the top cover of the present disclosure is not fastened to each crumple tube and, thus, may be removed and replaced within a very short amount of time. Airbag safety systems according to the present disclosure also allow for easy replacement of the top cover in the event an entity wants to "brand" or otherwise apply artwork onto the top cover for advertising purposes.

While the example implementations of the present disclosure have been described herein with reference to providing safety for human beings, the present disclosure may be employed for the safety of any subject, including animals, for example being rescued from a tree, or any object capable of falling from a height. In general, terms such as "coupled to," and "configured for coupling to" and "secured to" (for example, a first component is "coupled to" or "is configured for coupling to" or is "secured to" a second component), or "communicate" (for example, a first component "communicates with" or "is in communication with" a second component) are used herein to indicate a structural, functional, mechanical, electrical, signal, optical, magnetic, electromagnetic, ionic or fluidic relationship between two or more components (or elements, features, or the like). As such, the fact that one component is said to couple to a second component is not intended to exclude the possibility that additional components may be present between, and/or operatively associated or engaged with, the first and second components.

Although the previous description only illustrates particular examples of various implementations, the present disclosure is not limited to the foregoing illustrative examples. A person skilled in the art is aware that the disclosure as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. Modifications and variations are possible in light of the above description.

What is claimed is:

1. An airbag device to cushion the free fall of a subject from an elevated height comprising:

an inflatable base bag capable of sustaining an air pressure;

an inflatable structure comprised of a plurality of individual inflatable members, each comprising:

a wall with an annular cross-section; a top first end that is closed; and a second end opposite the first end, wherein the second end is coupled to an exterior upper surface of the base bag and is in fluid communication with the base bag, wherein a space is located between each of the individual inflatable members and the other inflatable members such that the individual inflatable members do not touch and are not in direct fluid communication with the other individual inflatable members;

a net directly attached by net fasteners to a top portion of the inflatable structure, the net comprising:

a first set of frame members;

a second set of frame members oriented transverse to the first set of frame members;

and wherein the first set of frame members are coupled to the second set of frame members by a plurality of knots and form a lattice having a plurality of open cells adapted to decelerate and support the subject from free fall; and a top cover attached indirectly to the base bag, the top cover having a top sheet and side sheets that substantially cover and enclose the inflatable structure, while not being directly attached by fasteners to the net or the inflatable structure.

2. The airbag device of claim 1, wherein the plurality of inflatable members of the inflatable structure are a plurality of crumple tubes sealably attached to the inflatable base bag, and wherein each crumple tube is in fluid communication with the base bag through an opening in the second end such that when inflated, the first end is located above the second end.

3. The airbag device of claim 1, wherein the base bag is separated into a plurality of sections by vented internal baffles, and wherein a plurality of breather holes are formed in a top wall of the base bag that permit airflow to and from the base bag and each individual inflatable member.

4. The airbag device of claim 3, wherein the plurality of inflatable members are a plurality of crumple tubes that are individually attached to the base bag over the breather holes at their second ends, wherein the second ends include an opening.

5. The airbag device of claim 4, wherein the net fasteners include at least a first loop of material directly connected to the top first end of a first crumple tube and a first rope passing through the first loop, a second loop of material directly connected to the top first end of a second crumple tube and a second rope passing through the second loop, wherein the first and second ropes pass through respective first and second open cells of the net, securing the net to the top first ends of the crumple tubes.

6. The airbag device of claim 4, wherein the net fasteners further comprise: a strip of material having one end affixed to one portion of the top first end of a first one of the crumple tubes and an opposite end carrying a strip of material that mates, in hook and loop engagement, with a corresponding strip of material affixed to a second portion of the top first end of said crumple tube and a strip of material operable to loop over at least one of the frame members forming the open cells of the net to secure the net to the top first end of said crumple tube.

7. The airbag device of claim 1, wherein the plurality of inflatable members are a plurality of crumple tubes that are arranged in a series of parallel rows and columns extending across a length and width of the base bag.

8. The airbag device of claim 1, where the crumple tubes are all about the same inflated height.

9. The airbag device claim 1, where at least one of the crumple tubes is taller than the others.

10. A safety system for cushioning the free fall of a subject from an elevated height comprising:

an inflatable base bag capable of sustaining an air pressure;

an inflatable structure coupled to the base bag, the inflatable structure comprised of a plurality of elongate individual inflatable members, each comprising:

an annular wall;

a closed top end; and an open end that is coupled to a top wall of the base bag, wherein each individual inflatable member is spaced apart and does not touch from the other inflatable members and is in individual fluid communication with the base bag such that each of the individual inflatable members is not in direct fluid communication with the other inflatable members;

a net connected to atop portion of the inflatable structure, the net comprising:

a first set of frame members;

a second set of frame members oriented transverse to the first set of frame members, wherein the first set of frame members are directly attached to the second set of frame members by a plurality of knots and form a lattice having a plurality of open cells adapted to decelerate and support the subject from free fall; and a top cover located over the net and attached directly to the base bag by at least one retaining member, the top cover having a top sheet and side sheets that substantially cover and enclose the net and inflatable structure, while not being directly attached by fasteners to the net or the inflatable structure.

11. The safety system of claim 10, wherein the plurality of inflatable members of the inflatable structure are a plurality of crumple tubes and the coupling of each crumple tube is sealably attached to the top wall of the base bag.

12. The safety system of claim 10, wherein the base bag is internally separated into a plurality of sections by vented baffles, and wherein a plurality of breather holes formed in the top wall of the base bag permit the fluid communication to and from the base bag and each individual inflatable member.

13. The safety system of claim 12, wherein the plurality of inflatable members are a plurality of crumple tubes that are attached to the base bag such that the open ends of the crumple tubes are located over the breather holes, and wherein at least two of the plurality of crumple tubes include fasteners for directly attaching the net to the closed top ends of the at least two crumple tubes.

14. The airbag device of claim 13, wherein the net fasteners include at least a first loop of material directly connected to the top first end of a first crumple tube and a first rope passing through the first loop, a second loop of material directly connected to the top first end of a second crumple tube and a second rope passing through the second loop, wherein the first and second ropes pass through respective first and second open cells of the net, securing the net to the top first ends of the crumple tubes.

15. The safety system of claim 13, wherein the fasteners further comprise:

a stationary strip of material affixed on a lower side to the closed top end of one of the crumple tubes and having an upper side with first portion of a hook and loop engagement apparatus; and a movable strip of material comprising:

one end that is affixed to one portion of the closed top end of said one of the crumple tubes; and an opposite, movable end having a second portion of a hook and loop engagement apparatus that is operable to couple with the first portion of the hook and loop apparatus, wherein the movable strip of material is operable to loop through-and-over at least one hole in the net to couple the net to the top portion of the inflatable structure.

16. The safety system of claim 13, wherein the net is directly attached to the top portion of the inflatable structure at the top end of each of the plurality of crumple tubes via the fasteners.

17. The safety system of claim 11, wherein the plurality of crumple tubes are arranged in a series of parallel rows and columns extending across a length and width of the base bag.

18. The safety system of claim 11, where the crumple tubes are all about the same inflated height.

19. The safety system claim 11, where at least one of the crumple tubes is taller than the others.

20. The safety system of claim 10, wherein said at least one retaining member is looped through at least one grommet hole formed in a bottom portion of the side sheets and at least one corresponding grommet hole formed in an upper portion of the base bag.

21. An airbag safety system to cushion the free fall of a subject from a height comprising:

an inflatable base bag capable of sustaining an air pressure;

a plurality of elongate crumple tubes, each individually comprising: an annular wall;

a closed top end; and an open end that is coupled to a top wall of the base bag, wherein each of the plurality of crumple tubes is individually in fluid communication with the base bag through the open end and each of the individual crumple tubes is spaced apart such that the individual crumple tubes are not in direct fluid communication with the other individual crumple tubes;

a plurality of fasteners affixed to the closed top end of a plurality of the elongate crumple tubes;

a net, attached to the elongate crumple tubes by the fasteners, comprising: a first set of frame members;

a second set of frame members oriented transverse to the first set of frame members; and wherein the first set of frame members are coupled to the second set of frame members by a plurality of knots and form a lattice having a plurality of open cells; and a top cover attached indirectly to the base bag, the top cover having a top sheet and side sheets that substantially cover and enclose the inflatable structure, while not being directly attached by fasteners to the net or the inflatable structure.

22. The safety system of claim 21, wherein the base bag is separated into a plurality of sections by vented baffles, and wherein a plurality of breather holes are formed in the top wall of the base bag permit the fluid communication to and from the base bag and each individual crumple tube.

23. The safety system of claim 22, wherein the open end of each of the crumple tubes is individually attached to the base bag over each of the breather holes.

24. The safety system of claim 21, further comprising:

a plurality of anchor straps directly attached to the base bag, each having a buckle for receiving a stake and maintaining the base bag in a fixed position with respect to the ground, and wherein the top sheet rests on top of the net and the side sheets of the top cover are attached directly to the base bag by a cord passed through grommet holes.

25. The safety system of claim 21, wherein each of the individual crumple tubes is spaced apart from and does not touch the other crumple tubes and the plurality of crumple tubes are arranged in a series of parallel rows and columns extending across a length and width of the base bag.

26. The safety system of claim 21, where the crumple tubes are all about the same inflated height.

27. The safety system claim 21, where at least one of the crumple tubes is taller than the others.

* * * * *